US011130246B2

(12) United States Patent
Busse

(10) Patent No.: US 11,130,246 B2
(45) Date of Patent: Sep. 28, 2021

(54) LOCKING FOLDING KNIFE AND KNIFE LOCK MECHANISM

(71) Applicant: Jerry P. Busse, Wauseon, OH (US)

(72) Inventor: Jerry P. Busse, Wauseon, OH (US)

( * ) Notice: Subject to any disclaimer, the term of this patent is extended or adjusted under 35 U.S.C. 154(b) by 0 days.

(21) Appl. No.: 17/126,079

(22) Filed: Dec. 18, 2020

(65) Prior Publication Data

US 2021/0197410 A1 Jul. 1, 2021

Related U.S. Application Data

(60) Provisional application No. 62/954,106, filed on Dec. 27, 2019.

(51) Int. Cl.
*B26B 1/04* (2006.01)

(52) U.S. Cl.
CPC ..... *B26B 1/042* (2013.01)

(58) Field of Classification Search
CPC ..... B26B 1/042; B26B 1/048; B26B 1/04; B26B 1/02; B26B 1/00; B26B 1/044
USPC ..... 30/153, 155, 158–161
See application file for complete search history.

(56) References Cited

U.S. PATENT DOCUMENTS

| | | | | |
|---|---|---|---|---|
| 7,032,315 | B1 * | 4/2006 | Busse | B26B 1/048 30/153 |
| 2004/0154169 | A1 * | 8/2004 | McCann | B26B 1/048 30/161 |
| 2011/0010947 | A1 * | 1/2011 | Freeman | B26B 1/048 30/159 |
| 2013/0263455 | A1 * | 10/2013 | Collins | B26B 1/044 30/159 |
| 2014/0115898 | A1 * | 5/2014 | Collins | B26B 1/048 30/159 |
| 2016/0354936 | A1 * | 12/2016 | Busse | B26B 1/048 |

* cited by examiner

*Primary Examiner* — Phong H Nguyen
(74) *Attorney, Agent, or Firm* — Kern Kendrick, LLC; Thomas Y. Kendrick

(57) ABSTRACT

Various embodiments of a folding knife are disclosed. In one embodiment, the folding knife includes a handle, a blade including a tip and a tang with the tang having a tang block engagement element, an axle pivotably connecting the blade to the handle, and a lock mechanism. The lock mechanism includes a locking block constrained to move along a fore-aft linear axis, the locking block including a lower engagement surface, an upper engagement surface, and a rear surface. The lock mechanism also includes a biasing device carrier pivotably connected to the handle, a biasing device oriented between the biasing device carrier and the rear surface of the locking block and the biasing device configured to bias the locking block toward the blade tip when the blade is in an open orientation, and at least one handle block engagement element oriented above the upper engagement surface of the locking block.

20 Claims, 11 Drawing Sheets

LOCKING FOLDING KNIFE AND KNIFE LOCK MECHANISM

CROSS-REFERENCE TO RELATED APPLICATIONS

This application claims priority from U.S. Provisional Patent Application No. 62/954,106, filed on Dec. 27, 2019, which is incorporated by reference herein in its entirety.

BACKGROUND

Folding knives often have a lock mechanism to prevent closing of the knife unless the lock mechanism is actuated by a user of the knife. The strength of the lock mechanism is often very important, as a user may use the knife to pry, which may place a large moment upon the blade, resulting in a large force applied to the lock mechanism. If the lock mechanism fails, or otherwise releases, the knife blade may close and contact the user's body, resulting in a potentially severe injury.

Many knife lock mechanisms are designed for two-handed deactivation. That is, a user must use two hands to actually deactivate the lock and close the knife. Many users prefer a knife lock mechanism that allows convenient one-handed deactivation. However, knife lock mechanisms designed to permit one-handed deactivation may have less strength than other knife lock mechanisms, including those designed for two-handed deactivation.

What is needed is an improved knife lock mechanism with increased strength.

SUMMARY

In one embodiment, a folding knife is provided, the knife comprising: a handle; a blade including a tip and a tang, the tang having a tang block engagement element; an axle pivotably connecting the blade to the handle; and a lock mechanism comprising: a locking block constrained to move along a fore-aft linear axis, the locking block including a lower engagement surface, an upper engagement surface, and a rear surface, a biasing device carrier pivotably connected to the handle, a biasing device oriented between the biasing device carrier and the rear surface of the locking block, the biasing device configured to bias the locking block toward the blade tip when the blade is in an open orientation, and at least one handle block engagement element oriented above the upper engagement surface of the locking block; wherein the lower engagement surface of the locking block engages the tang block engagement element when the blade is in an open orientation; wherein the upper engagement surface of the locking block engages the at least one handle block engagement element when the blade is in an open orientation; and wherein a moment applied to the blade toward a blade closed orientation causes a force extending from the tang block engagement element, through the locking block, and into the at least one handle block engagement element.

In another embodiment, a folding knife is provided, the knife comprising: a handle; a blade including a tip and a tang, the tang having a tang block engagement element; an axle pivotably connecting the blade to the handle; and a lock mechanism comprising: a locking block constrained to move along a fore-aft linear axis, the locking block including a lower engagement surface, an upper engagement surface, and a rear surface, a biasing device carrier pivotably connected to the handle, a biasing device oriented between the biasing device carrier and the rear surface of the locking block, the biasing device configured to bias the locking block toward the blade tip when the blade is in an open orientation, and two handle block engagement elements oriented above the upper engagement surface of the locking block, a first handle block engagement element being oriented aft of the tang block engagement element, and a second handle block engagement element being oriented fore of the tang block engagement element; wherein the lower engagement surface of the locking block engages the tang block engagement element when the blade is in an open orientation; wherein the upper engagement surface of the locking block engages the two handle block engagement elements when the blade is in an open orientation; and wherein a moment applied to the blade toward a blade closed orientation causes a force extending from the tang block engagement element, through the locking block, and into the two handle block engagement elements.

BRIEF DESCRIPTION OF THE DRAWINGS

The accompanying figures, which are incorporated in and constitute a part of the specification, illustrate various example configurations, and are used merely to illustrate various example embodiments. In the figures, like elements bear like reference numerals.

DETAILED DESCRIPTION

Figure 1A:
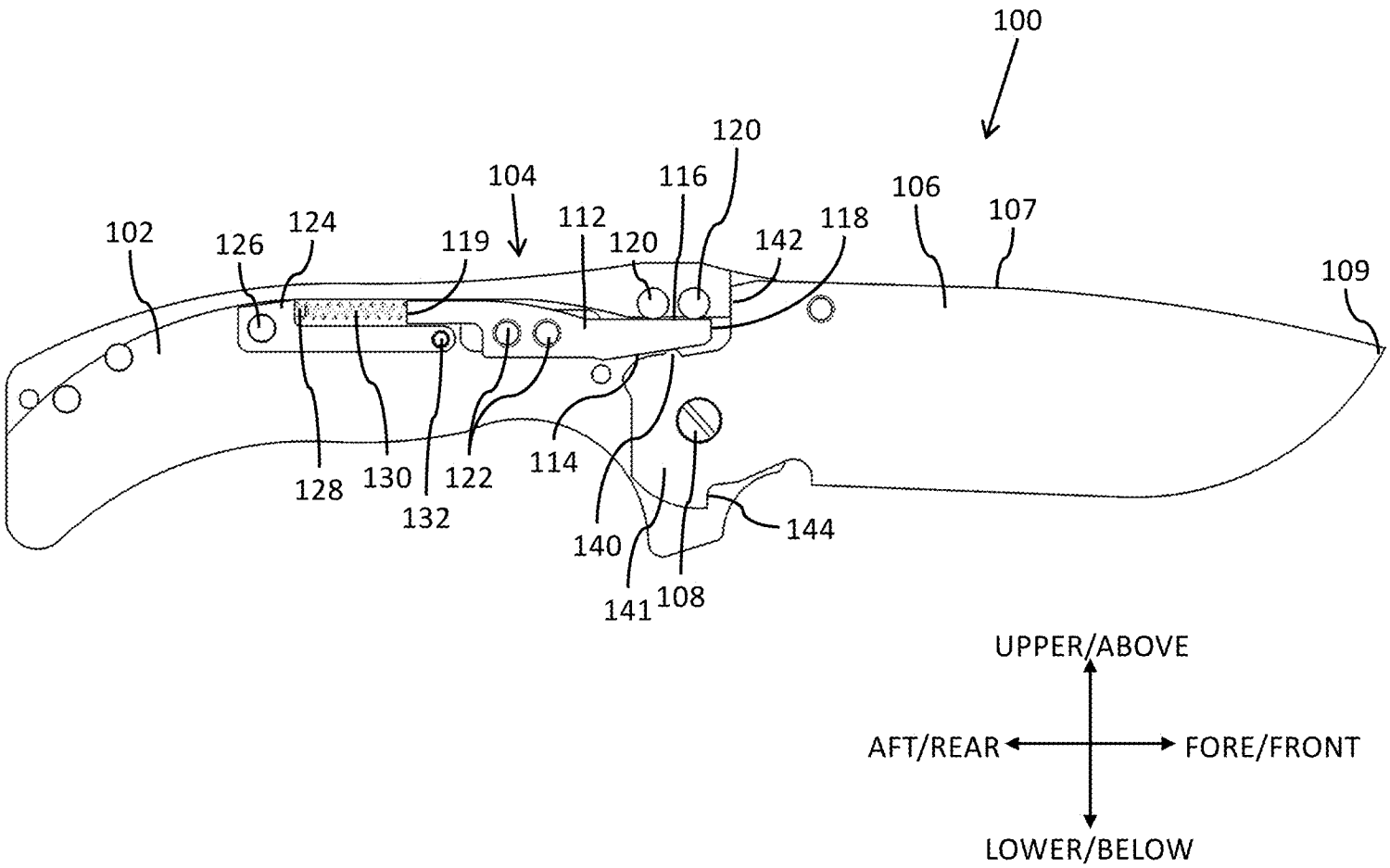
FIG. 1A illustrates an elevational view of an example embodiment of a locking folding knife 100 having a knife lock mechanism 104, in a blade 106 open orientation.

FIGS. 1A-1G illustrates a locking folding knife 100 having a handle 102, a knife lock mechanism 104, and a blade 106. Blade 106 is connected to handle 102 via an axle 108.

As illustrated in FIG. 1A, knife 100 includes reference directions: upper and above defined as toward the spine 107 of blade 106 when in the open orientation; lower and below defined as away from spine 107 of blade 106 when in the open orientation; fore and front defined as toward the tip 109 of blade 106 when in the open orientation; and aft and rear defined as away from tip 109 of blade 106 when in the open orientation.

Lock mechanism 104 may be oriented within handle 102. Lock mechanism 104 includes a locking block 112. Locking block 112 includes a lower engagement surface 114. Lower engagement surface 114 may be angled, such that it extends lower towards its aft end, and upwardly towards its fore end. Locking block 112 includes an upper engagement surface 116. Locking block 112 may include a front surface 118 and a rear surface 119.

Lock mechanism 104 may include at least one handle block engagement element 120. Lock mechanism 104 may include two handle block engagement elements 120. Handle block engagement elements 120 may be cylindrical in shape. As most easily viewed in FIG. 1E, handle block engagement elements 120 may extend through at least a portion of handle 102. Handle block engagement elements 120 may be integral to handle 102, or added to handle 102 following machining of handle 102. Handle block engagement elements 120 may be cylindrical pins added to handle 102 through handle engagement element aperture(s), illustrated in FIG. 2. Handle block engagement elements 120 may have rounded lower surfaces (e.g., with a sectional shape including a curve) that engage upper engagement surface 116.

At least one handle block engagement element 120 is oriented above (upwardly relative to) upper engagement surface 116.

Locking block 112 is constrained to move along a fore-aft linear axis. Locking block 112 includes at least one locking block input element 122. Input element 122 is any of a variety of elements that allow a user of knife 100 to manipulate locking block 112 along its fore-aft linear axis. As further described below, a user may manipulate locking block 112 in an aft direction to allow locking mechanism 104 to unlock, and blade 106 to rotate into handle 102. Input element 122 may extend outwardly from locking block 112 and at least partially through handle 102 in at least one direction (e.g., out at least one side of handle 102), to allow a user to manipulate input element 122 with a finger or thumb. Input element 122 may include knurling or other features to aid in the gripping of input element 122 by a user.

Lock mechanism 104 includes a biasing device carrier 124. Biasing device carrier 124 is pivotably connected to handle 102. Carrier 124 includes at least one carrier retainer 126, and pivots about a carrier pivot pin 132 that extends into and engages handle 102, carrier pivot pin 132 also extending through a carrier pivot aperture 170 within carrier 124. Alternatively, carrier pivot pin 132 is one or more cylindrical element (extending from one or both sides of carrier 124) integrally formed with carrier 124, in which instance carrier pivot aperture 170 is not necessitated or included.

Carrier retainer 126 engages handle 102 via carrier retainer handle aperture 150 to prevent pivoting of carrier 124 about carrier pivot pin 132 unless carrier retainer 126 is removed or manipulated by a user, and thus disengaged from its contact with carrier retainer handle aperture 150. That is, carrier retainer 126 is selectively engaged with carrier retainer handle aperture 150 to maintain carrier 124 in a closed position. As illustrated in FIGS. 1F and 1G, a user may manipulate carrier retainer 126 out of engagement with carrier retainer handle aperture 150, allowing carrier 124 to rotate about carrier pivot pin 132. This rotational aspect of carrier 124 is described further below.

Carrier retainer 126 may be a pin, bolt, or other element extending through carrier 124 and engaging handle 102 at aperture 150. Alternatively, carrier retainer 126 may include one or more spring-loaded elements able to be deflected out of contact with handle 102 and aperture 150, to allow pivoting of carrier 124.

Carrier 124 may include an index element 128, with which a biasing device 130 may be engaged at the aft end of biasing device 130. Index element 128 may be any of a variety of elements to engage biasing device 130 to maintain biasing device 130 into its position relative to carrier 124. Index element 128 may be a post extending at least partially into biasing device 130, or a cavity into which biasing device 130 extends.

Biasing device 130 may be any of a variety of biasing devices capable of biasing locking block 112 into a forward position (in the fore direction). Biasing device 130 may be a coil compression spring. Biasing device 130 may compress when locking block 112 is moved aft, thus causing a force biasing locking block 112 fore. The fore end of biasing device 130 may engage and exert force upon rear surface 119 of locking block 112.

Carrier 124 may be selectively rotated (as described above) downwardly about carrier pivot pin 132 to allow a user to access biasing device 130 for installation, removal, maintenance, replacement, and the like. While FIGS. 1A-1G illustrate knife 100 with its right handle panel removed, it will be understood that handle 102 may be machined as one part (with handle panels unable to be removed), thus necessitating access to biasing device 130 in such a manner. Alternatively, the handle panels may be removable, but accessing biasing device 130 in the manner described may simply be easier than removing a handle panel to access biasing device 130. Index element 128 may aide in the retention of biasing device in position upon carrier 124 during rotation of carrier 124.

Blade 106 may include spine 107 and tip 109, as noted above. It should be understood that blade 106 may not literally include a tip (e.g., it may be blunted rather than include a sharpened tip), but that for the purposes of the description herein, tip 109 is defined as the distalmost portion of blade 106 that extends away from handle 102 when blade 106 is in an open orientation. Additionally, blade 106 includes a tang 141, through which axle 108 extends. Tang 141 includes a tang block engagement element 140, and a blade closed retention surface 144. Blade 106 may additionally include a blade stop engagement surface 142. Tang block engagement element 140 may include a rounded profile, such that a rounded surface of tang block engagement element 140 contacts lower engagement surface 114.

When blade 106 is in an open orientation, blade stop engagement surface 142 engages handle 102 to prevent blade 106 from rotating past its open orientation. When blade 106 is in an open orientation, locking block 112 moves fore, causing tang block engagement element 140 to contact and engage lower engagement surface 114. As illustrated in FIGS. 1D and 1E, when blade 106 is in an open orientation and locking block 112 is oriented fore, any rotational moment imparted upon blade 106 in a direction that would (without lock mechanism 104's engagement) cause blade 106 to move toward a closed orientation results in tang block engagement element 140 being forced upwardly into contact with lower engagement surface 114. The force from element 140 upon lower engagement surface 114 causes a compressive force through locking block 112, into upper engagement surface 116, which is transmitted into the one or more handle block engagement element 120. FIGS. 1D and 1E illustrate this force F in an embodiment where knife 100 includes two handle block engagement elements 120 oriented in a line fore and aft of one another. Stated differently, using locking block 112 as a transfer element, an attempted closing of blade 106 in a locked state causes tang block engagement element 140 to impart a force into handle block engagement element 120.

In one embodiment, as illustrated in FIG. 1D, handle block engagement element 120 includes two handle block engagement elements 120 oriented fore and aft of one another. Tang block engagement element 140 is oriented between (in a fore-aft direction) the contact point of the two handle block engagement elements 120 with upper engagement surface 116. That is, the contact point of a first handle block engagement element 120 with upper engagement surface 116 is aft of tang block engagement element 140, and the contact point of a second handle block engagement element 120 with upper engagement surface 116 is fore of tang block engagement element 140. In this arrangement, the two resultant forces F may extend from tang block engagement element 140 to the two handle block engagement elements 120 along two inclined lines, one angled up and away from tang block engagement element 140 in an aft direction, and the other angled up and away from tang block engagement element 140 in a fore direction.

The design of locking block 112 having an angled lower engagement surface 114 may allow locking block to extend fore (under force from biasing device 130) to a position that it is effectively wedged between tang block engagement element 140 and handle block engagement element 120. This arrangement allows for locking block 112 to remain effective regardless of normal wear or machining imperfections in lower engagement surface 114, upper engagement surface 116, tang block engagement element 140, and/or handle block engagement element 120. Additionally, this arrangement allows a user to easily retract locking block 112 in an aft direction when user desires to close blade 106, minimizing or eliminating any "sticking" of locking block 112 in its fore position, and reducing the force required by a user to move locking block 112 to its aft position to close blade 106.

Where knife 100 includes a plurality of handle block engagement elements 120, the force imparted by tang block engagement element 140 may be spread over the plurality of handle block engagement elements 120, thus increasing the strength of the lock mechanism.

Figure 1B:
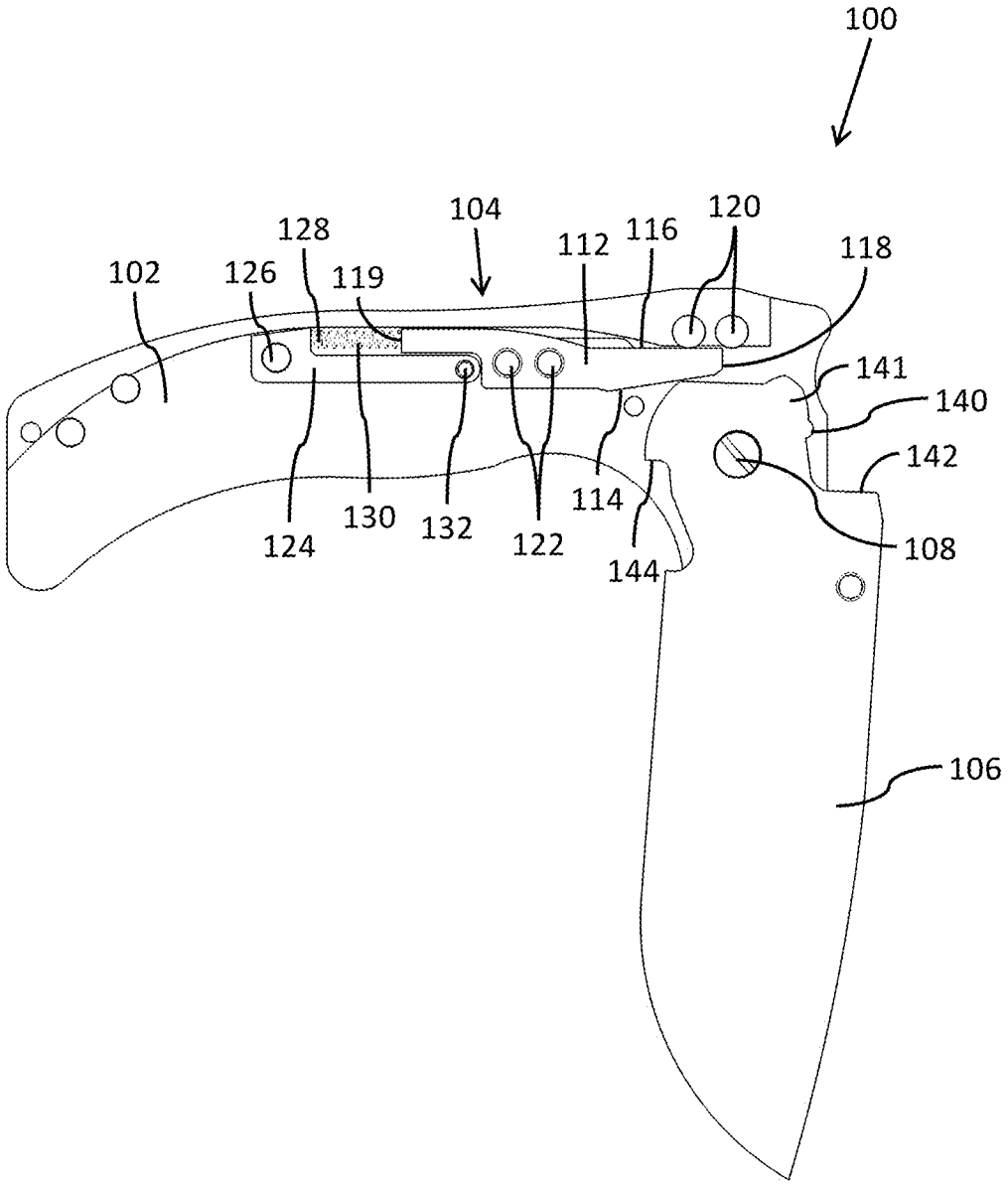
FIG. 1B illustrates an elevational view of an example embodiment of locking folding knife 100 having knife lock mechanism 104, in a blade 106 partially open orientation.

As illustrated in FIG. 1B, blade 106 is oriented in a partially open orientation.

Figure 1C:
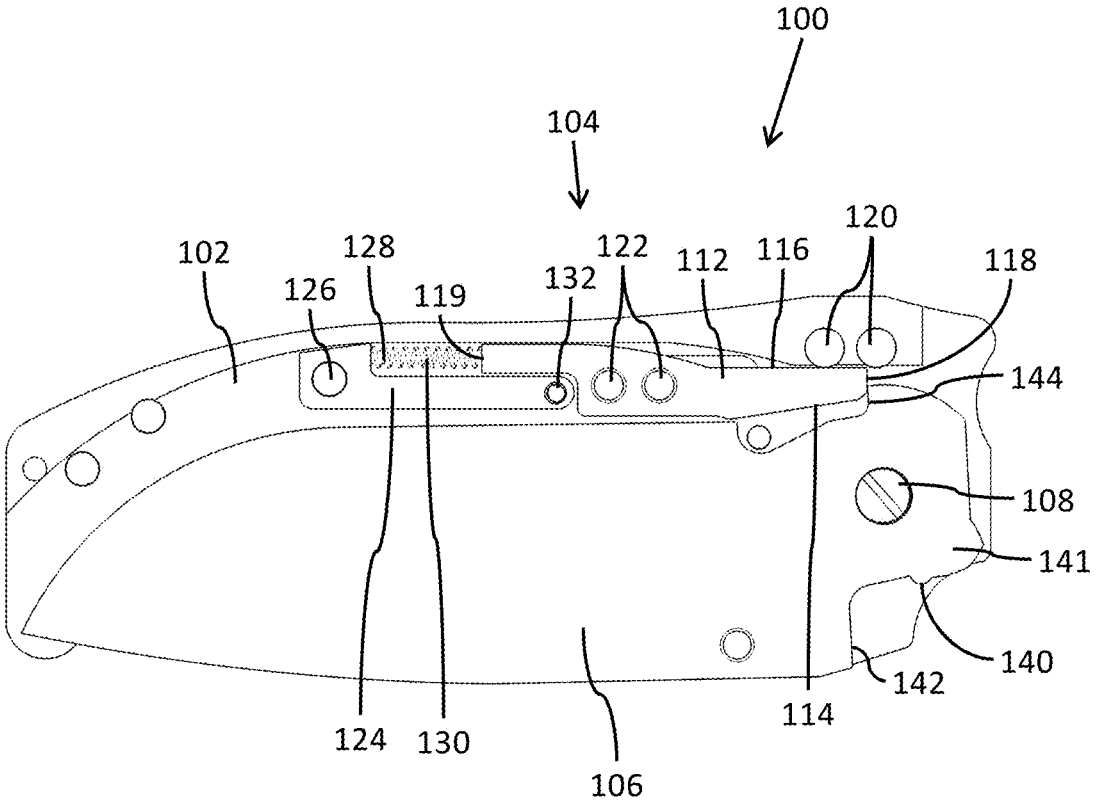
FIG. 1C illustrates an elevational view of an example embodiment of locking folding knife 100 having knife lock mechanism 104, in a blade 106 closed orientation.
Figure 1D:
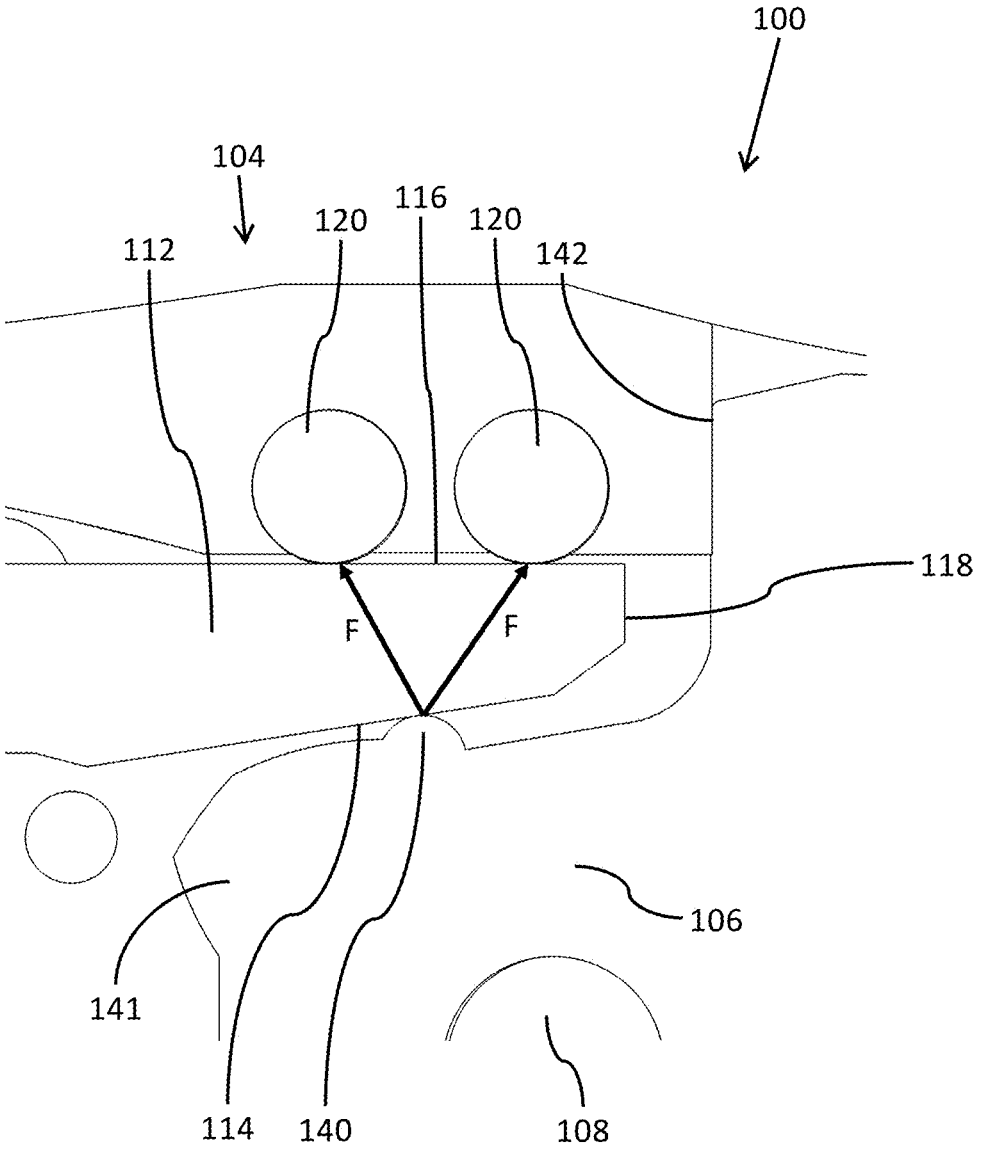
FIG. 1D illustrates a partial elevational view of an example embodiment of locking folding knife 100 having knife lock mechanism 104, in a blade 106 open orientation.
Figure 1E:
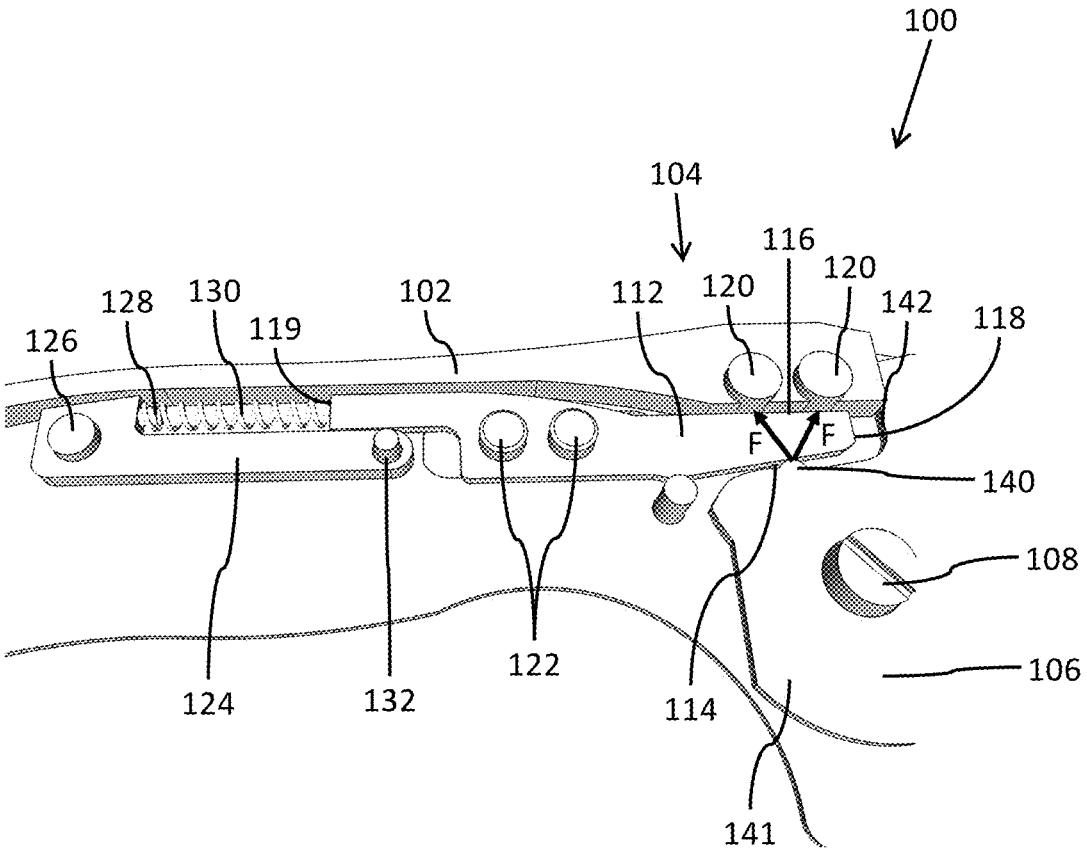
FIG. 1E illustrates a partial perspective view of an example embodiment of locking folding knife 100 having knife lock mechanism 104, in a blade 106 open orientation.
Figure 1F:
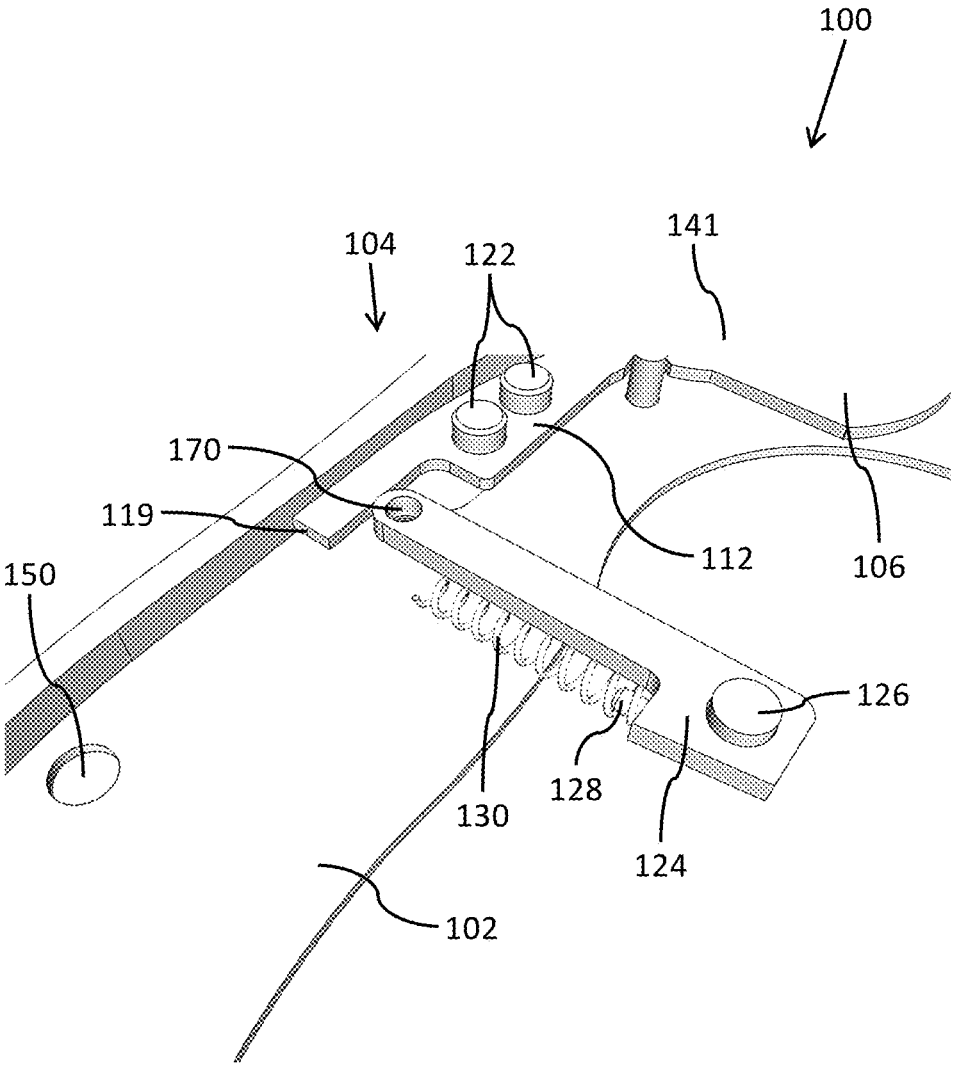
FIG. 1F illustrates a partial perspective view of an example embodiment of locking folding knife 100 having knife lock mechanism 104, in a blade 106 open orientation, and a biasing device carrier 124 open position.
Figure 1G:
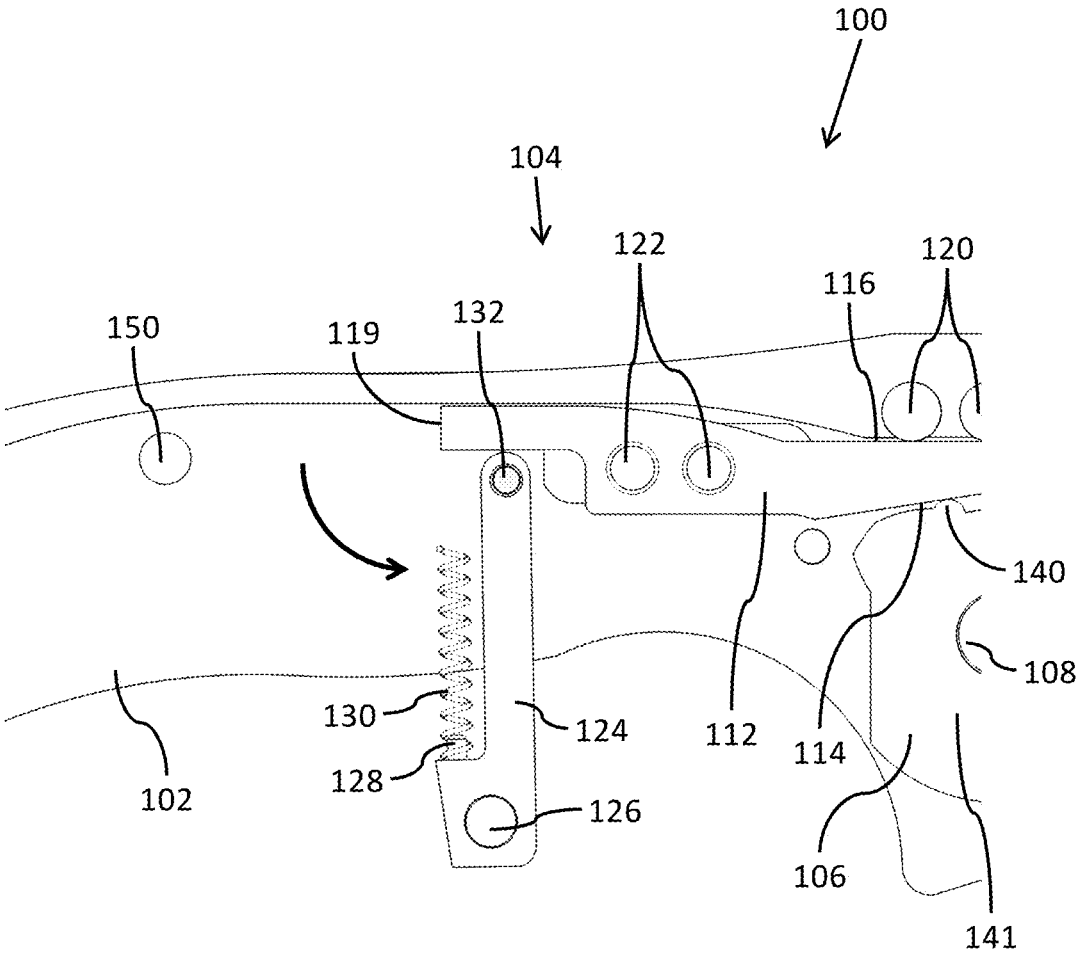
FIG. 1G illustrates a partial elevational view of an example embodiment of locking folding knife 100 having knife lock mechanism 104, in a blade 106 open orientation, and a biasing device carrier 124 open position.

As illustrated in FIG. 1C, when blade 106 is in its closed orientation, front surface 118 of locking block 112 may be biased into contact with blade closed retention surface 144 of blade 106. As a result, locking block 112 may aid in maintaining blade 106 in a closed position. Biasing device 130 may be selected with a spring rate that will allow a user to open blade 106 by simply manipulating blade 106 into an open orientation, or alternatively, may be selected with a spring rate that requires a user to move locking block toward its aft position to allow blade 106 to be opened.

Figure 2:
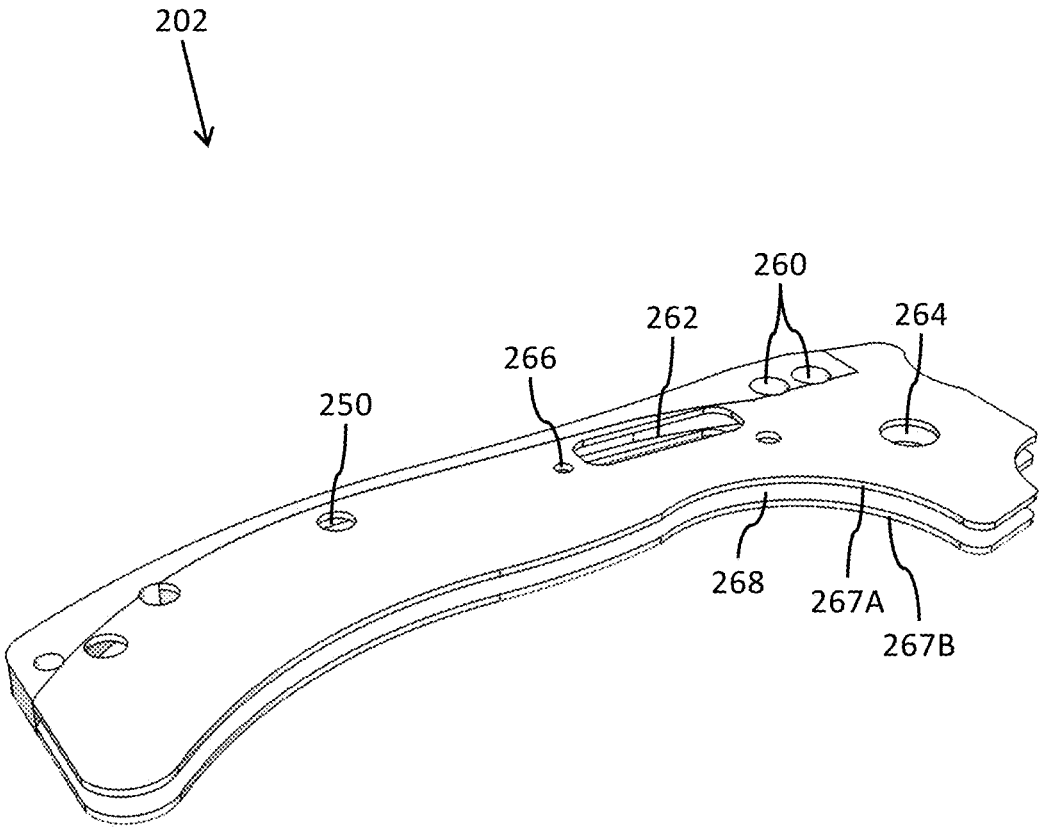
FIG. 2 illustrates a perspective view of an example embodiment of a handle 202.

FIG. 2 illustrates a perspective view of an example embodiment of a handle 202. Handle 202 may include a right handle panel 267A and a left handle panel 267B spaced apart from one another, forming a handle interior 268 therebetween. A blade (such as blade 106) may extend at least partially into handle interior 268 when the blade is in its closed orientation.

Handle 202 may be formed such that right handle panel 267A and left handle panel 267B are removable. Alternatively, handle 202 may be machined as one unit, such that right handle panel 267A and left handle panel 267B are integrally connected to handle 202, and thus not removable.

Handle 202 includes a carrier retainer handle aperture 250 extending at least partially through handle 202, with which carrier retainer 126 may be selectively engaged.

Handle 202 may include a handle engagement element aperture 260 for each handle block engagement element 120, the apertures 260 extending at least partially through handle 202, and within which handle block engagement elements 120 may be oriented.

Handle 202 includes at least one input element handle aperture 262 extending through one or both of right handle panel 267A and left handle panel 267B. Input element handle aperture 262 may be elongated in shape. At least one locking bar input element 122 (see FIGS. 1A-1G above) extends at least partially through input element handle aperture 262. The elongated shape of input element handle aperture 262 may accommodate the fore and aft linear motion of locking block 112 and accordingly, input element 122. A user may access and manipulate input element 122 through at least one input element handle aperture 262.

Alternatively, at least one input element 122 may extend through at least one input element handle aperture 262 and a user may access and manipulate input element 122 outside of input element handle aperture 262.

Handle 202 includes an axle handle aperture 264 extending at least partially through each of right handle panel 267A and left handle panel 267B, with which axle 108 engages.

Handle 202 includes a carrier pivot handle aperture 266 extending at least partially through handle 202, with which carrier pivot pin 132 engages.

Figure 3:
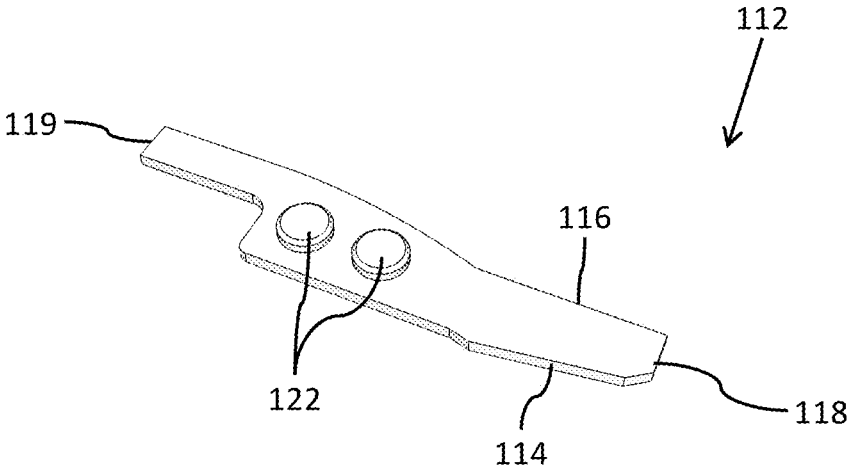
FIG. 3 illustrates a perspective view of an example embodiment of a locking block 112.

FIG. 3 illustrates a perspective view of an example embodiment of a locking block 112. Locking block 112 includes a lower engagement surface 114. Lower engagement surface 114 may be angled, such that it extends lower towards its aft end, and upwardly towards its fore end. Locking block 112 includes an upper engagement surface 116. Locking block 112 may include a front surface 118 and a rear surface 119. At least one locking block input element 122 may be oriented on one or both sides of locking block 112.

Figure 4:
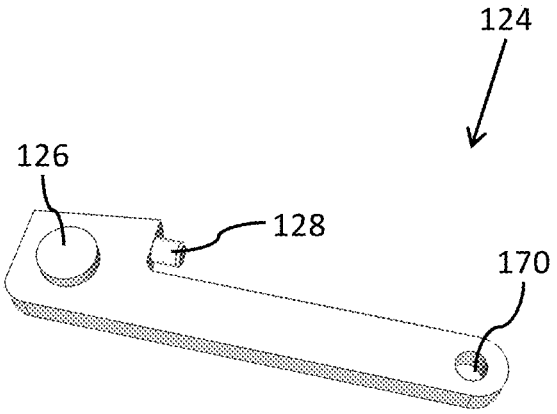
FIG. 4 illustrates a perspective view of an example embodiment of a biasing device carrier 124.

FIG. 4 illustrates a perspective view of an example embodiment of a biasing device carrier 124. Carrier 124 includes at least one carrier retainer 126, and pivots about a carrier pivot pin (not shown) extending through a carrier pivot aperture 170 within carrier 124. Carrier 124 may include an index element 128, with which a biasing device (not shown) may be engaged at the aft end of the biasing device. Index element 128 may be any of a variety of elements to engage biasing device 130 to maintain biasing device 130 into its position relative to carrier 124. Index element 128 may be a post extending at least partially into biasing device 130.

Figure 5A:
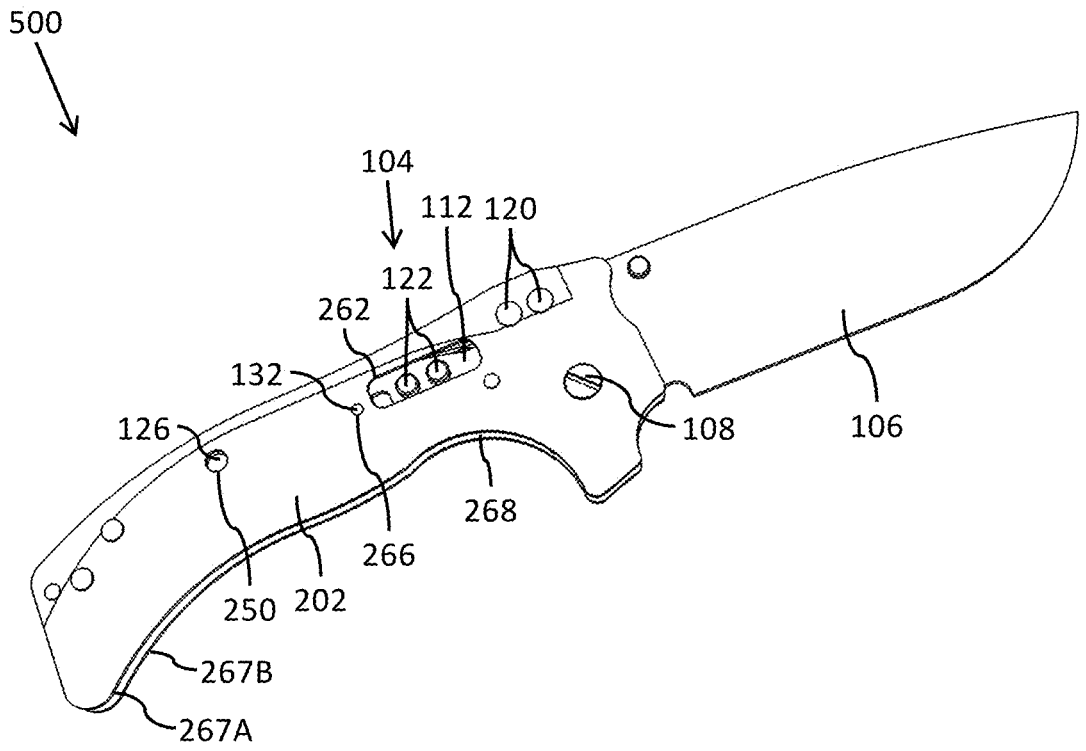
FIG. 5A illustrates a perspective view of an example embodiment of a locking folding knife 500 having a knife lock mechanism 104, in a blade 106 open orientation.
Figure 5B:
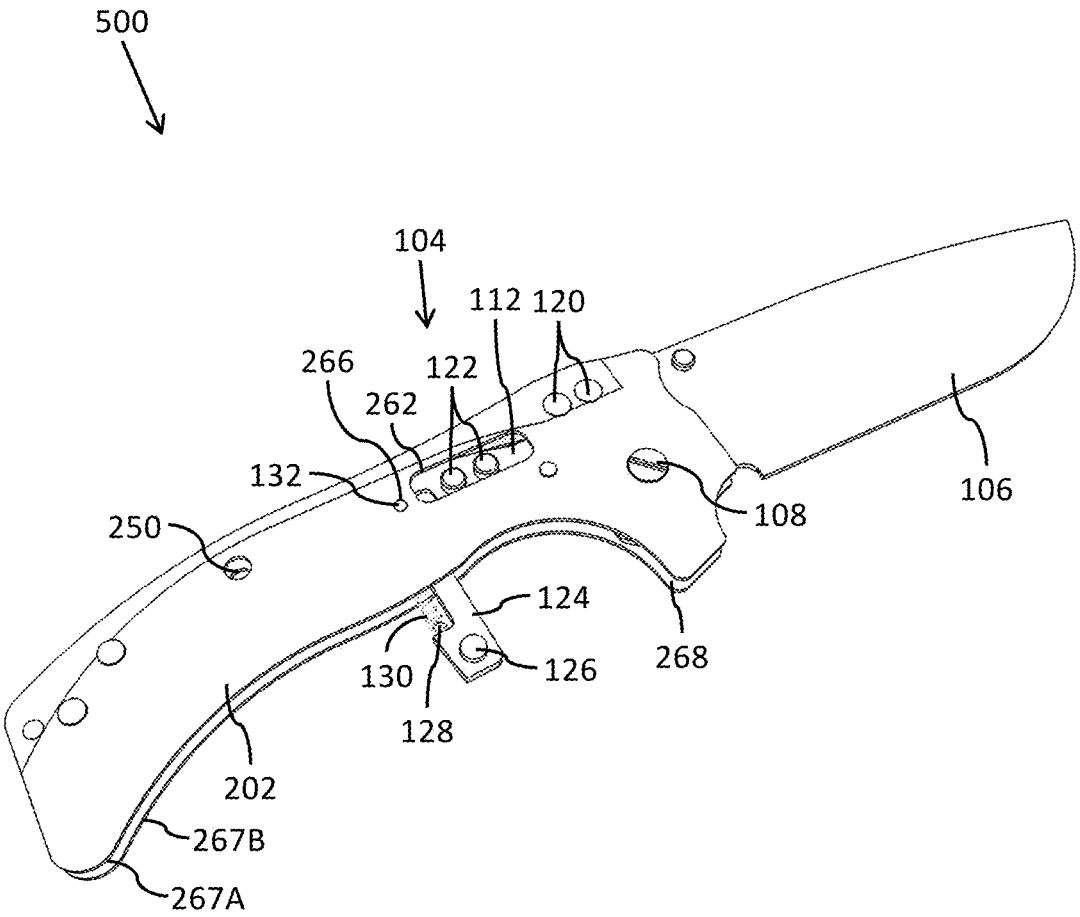
FIG. 5B illustrates a perspective view of an example embodiment of locking folding knife 500 having knife lock mechanism 104, in a blade 106 open orientation, and a biasing device carrier 124 open position.

FIGS. 5A and 5B illustrate perspective views of an example embodiment of a locking folding knife 500 having a knife lock mechanism 104. Elements and features described above in FIGS. 1A-1G, and 2-4 that are illustrated in FIGS. 5A and 5B are assigned the same reference numbers, and as such, the arrangements, properties, and descriptions of those elements above are imparted to knife 500.

Knife 500 includes a right handle panel 267A and a left handle panel 267B, which may be integrally formed with handle 202, or separately formed from handle 202 and attached to handle 202 thereafter.

Axle 108 pivotably attaches blade 106 to handle 202. In this manner, blade 106 is allowed to rotate relative to handle 202, within the constraints described above, and subject to the condition and actions of lock mechanism 104 as described above.

As illustrated in FIG. 5B, biasing device carrier 124 may be rotated downwardly and into an open position, such that a user may access biasing device 130 for installation, removal, maintenance, or replacement of biasing device 130. Such an arrangement may be necessitated or useful for accessing biasing device 130, particularly where right handle panel 267A and left handle panel 267B are attached to handle 202 integrally (i.e., machined with the rest of handle 202), or are formed separately and attached to handle 202 in a way that renders panels 267A, 267B difficult to remove (i.e., welded, riveted, press fit, glued, or bolted to handle 202).

It is noted that handle 202 may be at least partially covered with handle scales (not shown). The handle scales may at least partially cover the outer sides of right handle panel 267A and/or left handle panel 267B. The handle scales may include cutouts corresponding to input element handle apertures 262, or otherwise not cover input element handle apertures 262, to allow a user to access and manipulate locking block 112 via locking block input element 122.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include ±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

The invention claimed is:

1. A folding knife, comprising:

a handle;

a blade including a tip and a tang, the tang having a tang block engagement element;

an axle pivotably connecting the blade to the handle; and a lock mechanism comprising:

a locking block constrained to move along a fore-aft linear axis, the locking block including a lower engagement surface, an upper engagement surface, and a rear surface, a biasing device carrier pivotably connected to the handle, a biasing device oriented between the biasing device carrier and the rear surface of the locking block, the biasing device configured to bias the locking block toward the blade tip when the blade is in an open orientation, and at least one handle block engagement element oriented above the upper engagement surface of the locking block;

wherein the lower engagement surface of the locking block engages the tang block engagement element when the blade is in an open orientation;

wherein the upper engagement surface of the locking block engages the at least one handle block engagement element when the blade is in an open orientation; and wherein a moment applied to the blade toward a blade closed orientation causes a force extending from the tang block engagement element, through the locking block, and into the at least one handle block engagement element.

2. The folding knife of claim 1, wherein the lower engagement surface is angled.

3. The folding knife of claim 1, wherein the biasing device carrier includes an index element, and wherein the biasing device is engaged to the index element at an aft end of the biasing device.

4. The folding knife of claim 1, wherein the biasing device carrier includes a carrier retainer, wherein the handle includes a carrier retainer handle aperture, and wherein the carrier retainer is selectively engaged with the carrier retainer handle aperture to maintain the biasing device carrier in a closed position.

5. The folding knife of claim 1, wherein the handle includes a right handle panel and a left handle panel, each of which is integrally connected to the remainder of the handle.

6. The folding knife of claim 5, wherein a handle interior is defined between the right handle panel and the left handle panel.

7. The folding knife of claim 1, wherein the locking block includes at least one locking block input element, wherein the handle includes at least one input element handle aperture, and wherein the at least one locking block input element extends at least partially through the at least one input element handle aperture.

8. The folding knife of claim 1, wherein the locking block is moved to an aft position to allow the blade to move from a blade open orientation to a blade closed orientation.

9. The folding knife of claim 1, wherein the tang includes a blade closed retention surface, wherein the locking block includes a front surface, and wherein the front surface of the locking block engages the blade closed retention surface of the tang when the blade is in a closed orientation.

10. The folding knife of claim 1, wherein the biasing device is a coil compression spring.

11. A folding knife, comprising:

a handle;

a blade including a tip and a tang, the tang having a tang block engagement element;

an axle pivotably connecting the blade to the handle; and a lock mechanism comprising:

a locking block constrained to move along a fore-aft linear axis, the locking block including a lower engagement surface, an upper engagement surface, and a rear surface, a biasing device carrier pivotably connected to the handle, a biasing device oriented between the biasing device carrier and the rear surface of the locking block, the biasing device configured to bias the locking block toward the blade tip when the blade is in an open orientation, and two handle block engagement elements oriented above the upper engagement surface of the locking block, a first handle block engagement element being oriented aft of the tang block engagement element, and a second handle block engagement element being oriented fore of the tang block engagement element;

wherein the lower engagement surface of the locking block engages the tang block engagement element when the blade is in an open orientation;

wherein the upper engagement surface of the locking block engages the two handle block engagement elements when the blade is in an open orientation; and wherein a moment applied to the blade toward a blade closed orientation causes a force extending from the tang block engagement element, through the locking block, and into the two handle block engagement elements.

12. The folding knife of claim 11, wherein the lower engagement surface is angled.

13. The folding knife of claim 11, wherein the biasing device carrier includes an index element, and wherein the biasing device is engaged to the index element at an aft end of the biasing device.

14. The folding knife of claim 11, wherein the biasing device carrier includes a carrier retainer, wherein the handle includes a carrier retainer handle aperture, and wherein the carrier retainer is selectively engaged with the carrier retainer handle aperture to maintain the biasing device carrier in a closed position.

15. The folding knife of claim 11, wherein the handle includes a right handle panel and a left handle panel, each of which is integrally connected to the remainder of the handle.

16. The folding knife of claim 15, wherein a handle interior is defined between the right handle panel and the left handle panel.

17. The folding knife of claim 11, wherein the locking block includes at least one locking block input element, wherein the handle includes at least one input element handle aperture, and wherein the at least one locking block input element extends at least partially through the at least one input element handle aperture.

18. The folding knife of claim 11, wherein the locking block is moved to an aft position to allow the blade to move from a blade open orientation to a blade closed orientation.

19. The folding knife of claim 11, wherein the tang includes a blade closed retention surface, wherein the locking block includes a front surface, and wherein the front surface of the locking block engages the blade closed retention surface of the tang when the blade is in a closed orientation.

20. The folding knife of claim 11, wherein the biasing device is a coil compression spring.

* * * * *